US007430794B2

(12) United States Patent
Steffen

(10) Patent No.: US 7,430,794 B2
(45) Date of Patent: Oct. 7, 2008

(54) METHOD FOR REPLACING A DAMAGED RAILROAD FREIGHT CAR BRAKE BEAM

(75) Inventor: John J. Steffen, deceased, late of Lindenhurst IL (US); by Lee Ann Steffen, legal representative, Lindenhurst, IL (US)

(73) Assignee: Powerbrace Corporation, Kenosha, WI (US)

( * ) Notice: Subject to any disclaimer, the term of this patent is extended or adjusted under 35 U.S.C. 154(b) by 588 days.

(21) Appl. No.: 10/997,149

(22) Filed: Nov. 24, 2004

(65) Prior Publication Data

US 2006/0108187 A1 May 25, 2006

(51) Int. Cl.
*B23P 6/00* (2006.01)
*B61H 13/36* (2006.01)

(52) U.S. Cl. ..... 29/402.01; 188/219.1

(58) Field of Classification Search ..... 29/402.01, 29/402.12, 402.13; 188/219.6, 233.3, 219.1, 188/226.1, 223.1
See application file for complete search history.

(56) References Cited

U.S. PATENT DOCUMENTS 2,116,594 A 5/1938 Busch (Continued)

OTHER PUBLICATIONS

"Exhibit A" Four (4) photographs of a TRIAX railroad freight car brake beam (no date avaialbale).

(Continued)

*Primary Examiner*—John C Hong

(74) *Attorney, Agent, or Firm*—Law Office of John W. Harbst

(57) ABSTRACT

A method for replacing a damaged brake beam on a railcar having a car body supported on a railcar truck. The railcar truck includes a wheel and axle assembly mounted between a pair of laterally spaced side frames. The side frames include structure, on an inboard side thereof, for guiding and supporting the brake beam, and with the structure on the side frame members defining a predetermined lateral distance therebetween. The method comprises the steps of: removing the damaged brake beam from between the side frames of the railcar truck; arranging a first part of a replacement brake beam structure into supported and guided relation with the brake beam guide on the first side frame, with the first part of the brake beam structure having an operative length shorter than the predetermined distance between the brake beam guides on the first and second side frames; arranging a second part of the replacement brake beam structure into supported and guided relation with the brake beam guide on the second of the side frames, with the second part of the brake beam structure having an operative length shorter than the predetermined distance between the brake beam guides on the first and second side frames; securing the first and second parts of the replacement brake beam structure to each other to form a rigid assembly capable of withstanding the braking forces applied thereto during operation of the railcar and with the combined operative lengths of the first and second parts of the replacement brake beam structure being substantially equivalent to the predetermined distance between the brake beam guides on the first and second side frames; and providing a brake head in operable combination with each of the first and second parts of the replacement brake beam structure for movements toward and away from the wheels as the first and second parts forming the rigid assembly move within the brake beam guides on the side frames.

43 Claims, 5 Drawing Sheets

U.S. PATENT DOCUMENTS

| | | | | |
|---|---|---|---|---|
| 2,170,118 | A | 8/1939 | Busch | |
| 2,170,123 | A | 8/1939 | Busch | |
| 2,193,580 | A | 3/1940 | Busch | |
| 2,226,551 | A | 12/1940 | Busse | |
| 2,226,704 | A | 12/1940 | Busch | |
| 2,254,513 | A | 9/1941 | Busse | |
| 2,310,195 | A | 2/1943 | Busch | |
| 2,340,927 | A | 2/1944 | Busch | |
| 2,350,671 | A | 6/1944 | Busch | |
| 2,364,021 | A | 11/1944 | Flesch | |
| 2,398,917 | A | 4/1946 | Busch | |
| 2,525,762 | A | 10/1950 | Baselt | |
| 2,529,352 | A | 11/1950 | Sale | |
| 2,547,860 | A | 4/1951 | Flesch | |
| 2,570,202 | A | 10/1951 | Busch | |
| 2,747,264 | A * | 5/1956 | Buvelot | 29/402.13 |
| 2,808,906 | A | 10/1957 | Busch | |
| 2,930,329 | A | 3/1960 | Busch | |
| 3,703,225 | A | 11/1972 | Spaeth | |
| 3,731,766 | A | 5/1973 | Campbell | |
| 5,456,337 | A | 10/1995 | Jackson | |
| 5,546,869 | A | 8/1996 | Nassar | |
| 5,810,124 | A | 9/1998 | Sandmann | |
| 6,155,388 | A | 12/2000 | Sandmann | |
| 6,155,389 | A | 12/2000 | Sandmann | |
| 6,234,283 | B1 | 5/2001 | Montes-Ramos | |
| 6,551,003 | B1 | 4/2003 | DeLa Fuente-Faria | |
| 2004/0190978 | A1 | 9/2004 | DeLa Fuente-Faria | |
| 2004/0190979 | A1 | 9/2004 | DeLa Fuente-Faria | |
| 2006/0219501 | A1 * | 10/2006 | De La Fuente-Farias | 188/219.1 |

OTHER PUBLICATIONS

"Exhibit B" Five (5) plhotograhs of an Acertek S.A. de C.V. railroad freight car brake beam (no date available).

Association of American Railroads, 2004 Office Manual of the AAR Interchange Rules—Price Matrix, Jul. 1, 2004, pp. 1, 24, 25, 86, 92 & 93.

Simmons-Boardman Books Inc., Understaneding and Servicing Freight Car Brake Rigging, 1976 and Sep. 2002.

* cited by examiner

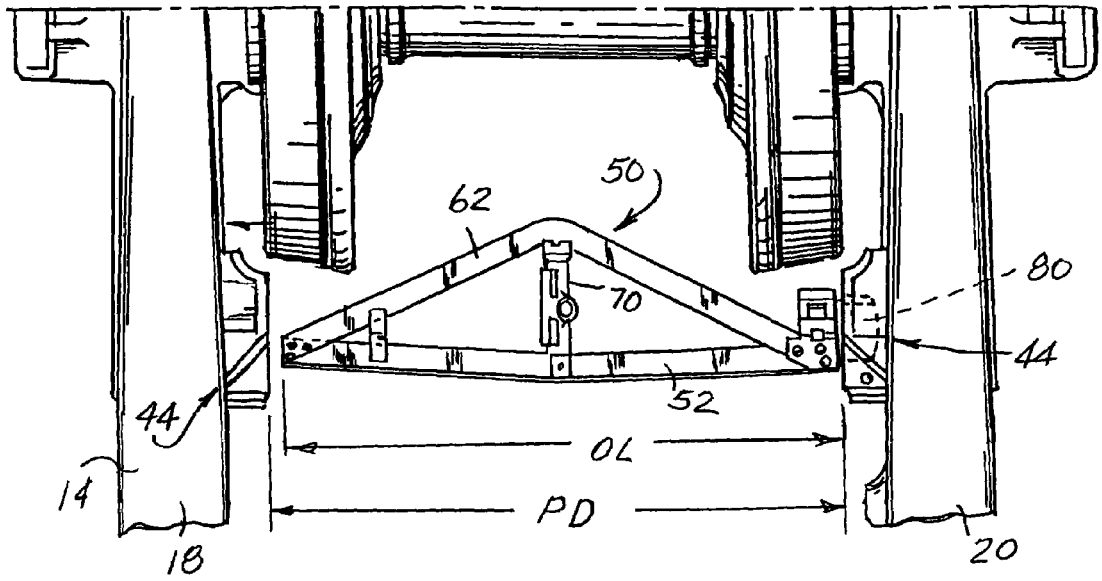
FIG. 7
FIG. 8
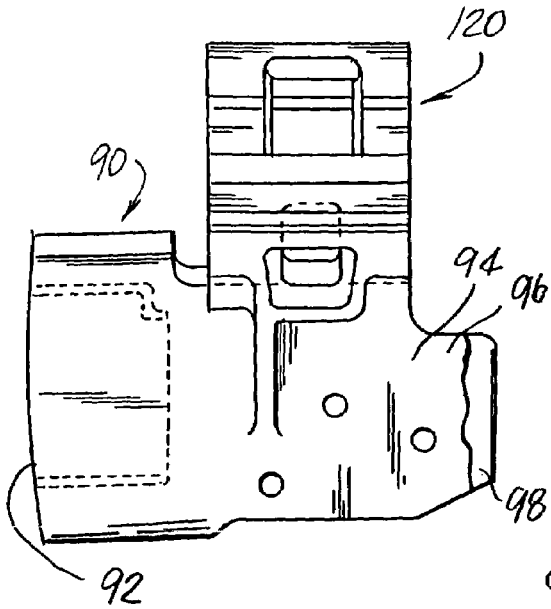
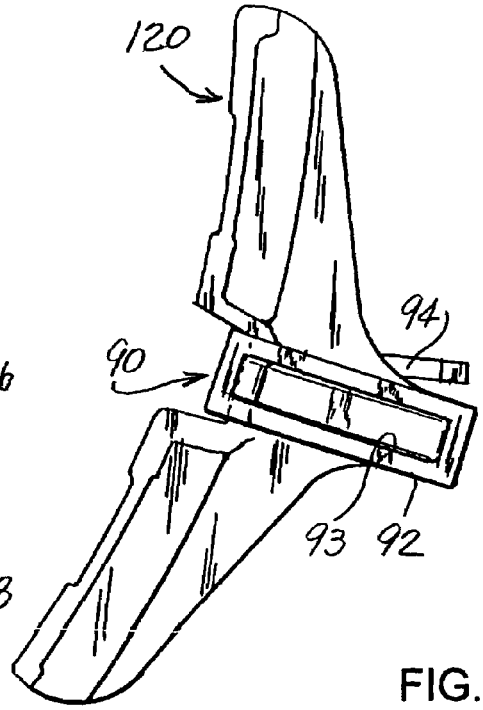
FIG. 9

METHOD FOR REPLACING A DAMAGED RAILROAD FREIGHT CAR BRAKE BEAM

FIELD OF THE INVENTION

The present disclosure generally relates to railroad freight cars and, more particularly, to a method for replacing a damaged brake beam on a railroad freight car.

BACKGROUND OF THE INVENTION

Railroad freight cars typically include an elongated car body supported toward opposite ends by a pair of wheeled trucks. Each wheeled truck includes a bolster laterally extending between two side frames with a wheel and axle assembly arranged to front and rear sides of the bolster. Each railcar also has a brake system operably associated therewith. A conventional brake system includes a brake beam assembly associated with each wheel and axle assembly and which is connected to brake rigging on the car. Each brake beam assembly is supported between the truck side frames to allow it to be operated into and out of braking positions in relation to the respective wheel and axle assembly.

A typical brake beam assembly primarily includes compression and tension members fastened to each other at their ends where a brake head is located and separated at the middle by a strut or fulcrum. It has been found beneficial for the brake beam assembly to maintain both a degree of camber in the compression member and a degree or level of tension in the tension member. Each brake head on the brake beam assembly is preferably configured to have a brake shoe connected to and carried thereby. Moreover, an end-guide extends from each end of the brake beam assembly and is supported for sliding movements within cast slots or guides provided on an inner face of each side frame of the wheeled truck.

The brake beam assemblies on the railcar are operated in simultaneous relation by a power source from a brake cylinder or a hand brake and, through leverage, transmit and deliver braking forces to the brake shoes at the wheels of each wheel and axle assembly. On a typical railcar, the brake rigging, including a brake push rod, transmits force, caused by the push of air entering the brake cylinder or by the pull of the hand brake, to the brake shoes.

The brake rigging on the railcar, used to transmit and deliver braking forces to the braking shoes of each wheel assembly, comprises a multitude of linkages including various levers, rods and pins. For example, brake levers are used throughout the brake rigging on each car to transmit as well as increase or decrease the braking force on each wheel and axle assembly. The distance between various holes or openings on the brake levers determine the force transmitted to or between the various levers. Besides transferring force, the linkages of the brake rigging are also used to change the direction of force. The levers used in a brake rigging are named from the various conditions and positions they serve. For example, there are body levers, such as the cylinder lever and fulcrum lever, and there are truck levers, such as a live truck lever and a dead truck lever associated with each wheeled truck on the railcar.

The strut or fulcrum of each brake beam assembly pivotally supports either a live or dead truck lever. Besides being pivotally supported by the brake beam assembly strut, one end of the live truck lever is articulately connected to a longitudinally elongated top rod whose opposite end is connected to the cylinder lever of the railcar brake rigging. As is known, and besides being pivotally supported by the strut of the other brake beam assembly on the wheeled truck, the dead truck lever is articulately connected, intermediate the strut and the free end thereof, to the live truck lever by a truck lever connection. The free end of the dead truck lever is typically fulcrumed to the truck bolster or car body by a guide used to adjust the brakes. As known, a center rod serves to articulately connect the cylinder lever and fulcrum lever through a slack adjuster of the brake rigging. Suffice it to say, there are multiple articulate connections between the various body levers, truck levers, and operating rods comprising the brake rigging on a railcar.

During use, a railcar can travel tens of thousands of miles between locations and over railbeds, some of which can be in significant disrepair. Accordingly, and although most component parts of the brake beam assembly are made from steel, it is not unusual for one or more of the brake beam assembly components or parts on one or more of the brake beam assemblies on the railcar to become cut, worn, twisted, dented, cracked or broken under the relative high forces imparted thereto. Of course, severe wear, cracking, denting, twisting or breaking of a brake beam assembly component part can adversely affect railcar braking performance and, thus, result in condemnation of the brake beam. As will be appreciated, parts of or, in severe cases, sometimes the entire brake beam assembly may be missing from the railcar.

Accordingly, railroad freight cars are routinely inspected. Part of the inspection process involves an analysis of each railcar brake beam assembly on the railcar. Heretofore, when a particular railroad freight car is identified as having a brake beam assembly requiring repair or replacement, the freight car requiring such repair must be initially separated from the remaining cars in the train consist and, then, moved to a facility where such repairs can be affected. Separating that particular freight car from the remaining cars in the train consist, coupled with moving that railcar, along with scheduling of the required repairs can take hours if not days. Of course, during this time, the railcar requiring such repair must be and is removed from service.

Only after a suitable repair facility has been identified and becomes available, can replacement of the damaged brake beam assembly be affected. The heretofore known method for replacing a damaged railcar brake beam assembly is a time consuming process. One of the first steps in such process involves disconnecting those linkages of the brake rigging from the damaged brake beam assembly. That is, the damaged brake beam assembly needs to be disconnected from the truck levers, operating rods and other linkages of the brake rigging as well as from the other brake beam assembly mounted on the respective railcar truck.

That end of the railcar body supported by the wheeled truck having the defective brake beam assembly needs to be sufficiently elevated or raised to allow the wheeled truck to be rolled from under the railcar body to a predetermined location. As will be appreciated by those skilled in the art, an empty railroad freight car can weigh tens of thousands of pounds. A hopper car filled with a commodity can weigh 50 or more tons. Accordingly, lifting of the railcar body involves using special hydraulic jacks connected to a suitable hydraulic pump or other suitable hydraulic pressure source for raising and, thus, separating the wheeled truck from the railcar body. As will be appreciated, suitable hydraulic conduits or hoses need to extend between the hydraulic jacks and the hydraulic pump. Moreover, such hydraulic jacks need to be positioned over a concrete pad suitably constructed to withstand the weight of the freight car being lifted by the jacks. To promote the distribution of the freight car weight over a broadened or increased area, suitable planks of wood or other suitable material are typically placed under each hydraulic jack.

After the railcar body is raised and separated therefrom, the wheeled truck having the defective or condemned brake beam assembly thereon is rolled from beneath and away from the railcar body. Thereafter, a specially designed truck hoist is positioned adjacent to the railcar truck such that the ends of the side frames, adjacent to the defective brake beam assembly, can be conjointly and pivotally elevated to allow the wheel and axle assembly, arranged adjacent to the condemned brake truss assembly, to be removed from between the side frames. As is known, a typical railcar truck further includes a wheel bearing adapter positioned between each side frame and each end of the wheel and axle assembly. In an effort to avoid damage to the wheel bearing adapters when the side frames are elevated, steps must be taken to temporarily maintain each adapter in positional relation relative to the respective side frame of the wheeled truck to inhibit inadvertent separation of the adapter from the elevated side frame.

After pivotally raising the side frames ends of the relevant wheel and axle assembly and removing the wheel and axle assembly from between the side frames is there sufficient access to permit removal of the defective brake beam assembly. With the wheel and axle assembly so removed, replacing the condemned brake beam assembly further involves displacing or prying the side frames of the respective railcar truck in opposed lateral directions relative to each other. Notably, only after prying the side frames laterally apart from each other is the distance between the side frames sufficiently increased to finally allow the free ends of the defective brake beam assembly to be removed from within the cast slots or guides on the side frames of the railcar truck. Some newer designs of freight car wheeled trucks require a special tool for laterally spreading the side frames in opposed lateral directions to increase the lateral spacing therebetween. In either case, and as will be appreciated, great care must be exercised in laterally spreading the side frames apart from each other so as to limit damage to the bearings mounting the other wheel and axle assembly on the wheeled truck.

After having finally removed the damaged/defective brake beam assembly, a new brake beam assembly can be positioned for installation into operable combination with the railcar truck. That is, and with the side frames of the truck remaining pried laterally apart to substantially increase the distance between the cast slots or guides on the side frames, the free ends of the new brake beam are aligned with their respective cast slots or guides on the side frames and the side frames are again brought back to their conventional position. As such, the free ends of the brake beam are entrapped within the cast slots or guides on the side frames for guided reciprocatory movements. With some newer wheeled railcar truck designs, considerable effort can be required to return the side frames such that a standard lateral spacing is provided therebetween.

After a replacement brake beam is installed into operable combination with the side frames, the wheel and axle assembly is returned beneath the raised ends of the side frames. The side frames are lowered onto the wheel and axle assembly and those devices used to temporarily maintain each wheel bearing adapter in fixed positional relation relative to a respective side frame can be removed. After having replaced the brake beam assembly, and after returning the side frames to their original position, and after having arranged the wheel and axle assembly in operable combination with the side frames, the reassembled railcar truck can be again rolled beneath the raised end of the railcar body. The jacks or lifts are operated to lower the railcar body onto the railcar truck having the replacement brake beam associated therewith. Next, the jacks, their hydraulic hoses, and wood planking can be removed from the area adjacent to the railcar body. After the brake rigging linkages are again connected to the brake beam, replacement of the brake beam assembly is finally complete. Thereafter, the railcar having the replacement brake beam mounted thereon needs to be joined to another train consist and is again routed to its original destination.

The American Association of Railroads (the "AAR") has established a recommended time frame for completing replacement of a damaged brake beam assembly. According to the AAR, replacement of a brake beam should be accomplished within 1.44 hours. It should be appreciated, however, the 1.44 hours allocated by the AAR for replacement of a brake beam assembly neither considers the valuable time lost in separating the railcar with the damaged brake beam from the remaining cars in the train consist, nor the time lost in scheduling a repair facility to accomplish replacement of the brake beam assembly, nor the time lost in having to move the car with the damaged brake beam to the repair facility for replacement of the brake beam assembly. Additionally, the time allocated by the AAR does not consider the time lost in joining the repaired car to a train consist directed toward the original destination of the repaired car. Moreover, the overhead costs of the special equipment required to lift the railcar body from the wheeled truck, along with that special equipment used to elevate the ends of the railcar side frames from operable association with the relevant wheel and axle assemblies, and related special equipment used to affect replacement of the brake beam assembly needs to be considered.

Thus, there is a continuing need and desire for a method for replacing a brake beam assembly on a railroad freight car which is less time consuming and, overall, less costly than heretofore known and long accepted procedures.

SUMMARY OF THE INVENTION

In view of the above, and in accordance with one aspect, there is provided a method for replacing a damaged brake beam truss assembly connected to brake rigging linkages on a railcar having a car body supported on a railcar truck while maintaining the railcar truck and the car body in operable association with each other. The railcar truck includes a wheel and axle assembly including a pair of laterally spaced wheels mounted between a pair of laterally spaced side frame members. The side frame members include structure on an inboard side thereof for guiding and supporting the brake beam truss assembly, and with the structure on the side frame members defining a predetermined lateral distance therebetween.

The method comprises the steps of: removing the damaged brake beam truss assembly from between the side frame members of the railcar truck while maintaining the railcar truck and the car body in operable association with each other; arranging a first end-guide, defining one end of a truss beam subassembly, into guided and supported sliding relation relative to the structure on one of the side frame members, with the truss beam subassembly further including compression and tension members each having a first end secured to each other, and wherein the truss beam subassembly has an overall length shorter than the predetermined lateral distance between the structure on the side frame members to allow the truss beam subassembly to be arranged in operable combination with the structure on one side frame member while maintaining the railcar truck and car body in operable association with each other, and with the first end-guide having a free distal end; arranging a second end-guide in guided and supported sliding relation relative to the structure on the other side frame member, with the second end-guide having a free distal end; securing or coupling the second end-guide and a second end of the truss beam subassembly, opposite from the first end-guide, to each other so as to form a rigid brake beam unit and such that the free distal ends of the end-guides are guided and supported for sliding movements between the structure on the side frame members of the railcar truck, with the second end-guide being secured to the truss beam subassembly while the railcar truck and car body are maintained in operable association with each other; and providing first and second brake heads in operable combination with and toward the first and second ends, respectively, of the truss beam subassembly for movements toward and away from the wheels on the wheel and axle assembly as the first end-guide and second guide slidably move within the structure on the side frame members.

According to this aspect, removing the damaged brake beam truss involves the step of: disconnecting the brake rigging linkages extending from and connected to the damaged brake beam truss. Moreover, and according to this first aspect, the step of removing the damaged brake beam truss involves the step of: shortening the operative length of the damaged brake beam truss to facilitate removal of the damaged brake beam truss while maintaining the railcar truck and the car body in operable association with each other. According to this first aspect, the first end-guide, defining one end of the brake beam truss subassembly, is preferably formed as an integral part of one of the brake heads on the brake beam unit.

Preferably, the methodology further includes the step of: imparting both compression and tension forces to the compression and tension members, respectively, of the truss beam subassembly. Moreover, a preferred methodology includes the further step of: maintaining a compressive force between first and second ends of the compression member and a tension force between first and second ends of the tension member of the truss beam subassembly prior to and after the brake beam truss subassembly is secured to the second end guide such that the members of the subassembly maintain and operate under both compression and tension forces. A preferred methodology further includes the further step of: providing a series of aligned openings toward the second ends of the compression and tension members disposed opposite from the first end of the brake beam truss subassembly.

Preferably, the second end-guide is integral with and laterally extends from one side of the second brake head. In this respect, the methodology further includes the step of: providing that second brake head, with the second end-guide formed as an integral part thereof, with a flange portion extending laterally outward and on an opposite side from the second end-guide, with the flange portion defining a series of holes which align with the openings provided toward the second ends of the compression and tension members. According to this aspect, the step of securing the second end-guide to that end of the truss beam subassembly opposite from the first end-guide includes the further step of: providing a series of fasteners configured to pass endwise through the series of holes in the flange portion of the second brake head and through the openings toward the second ends of the compression and tension members to permit the second end-guide to be secured to the truss beam subassembly.

According to another aspect, there is provided a method for replacing a damaged brake beam connected to brake rigging linkages on a railcar having a car body supported on a railcar truck while maintaining the railcar truck and the car body in operable association with each other. The railcar truck includes a pair of laterally spaced side frames for supporting an axle and wheels therebetween. Each of the side frames includes, on an inboard side thereof, a brake beam guide extending for a length at least equivalent to the extent of travel of the brake beam, and with the brake beam guides on the side frames being separated by a predetermined distance.

According to this aspect, the method comprises the steps of: removing the damaged brake beam from between the side frames of the railcar truck while maintaining the railcar truck and car body in operable association with each other; providing a brake beam subassembly comprised of a compression member and an angled tension member, the tension member having a maximum depth toward a mid-portion thereof, and with the first ends of the compression member and the tension member being secured together, and with a first or fixed guide, having a free distal end, being disposed adjacent the first ends of the compression and tension member to define a first end of the brake beam subassembly, and with a second end of each of the compression member and tension member being maintained in predetermined relation relative to each other so as to maintain a compression force in the compression member and a tension force in the tension member, and wherein an operable length of the brake beam subassembly is shorter than the predetermined distance separating the brake beam guides on the side frames of the railcar truck; arranging the free distal end of the first or fixed guide into one of the brake beam guides on one of the side frames such that the first guide is disposed to guide and support one end of the brake beam subassembly for sliding movements while maintaining the railcar truck and car body in operable association with each other; arranging a second guide, independent of the brake beam assembly, into operable combination with the brake beam guide on the side of the side frames such that the second guide is disposed to guide and support a second end of the brake beam subassembly while maintaining the railcar truck and car body in operable association with each other; fastening or coupling the second guide the second end of the brake beam subassembly opposite from the first end to each other while maintaining the railcar truck and car body in operable association relative to each other to form a rigid brake beam unit guided and supported for sliding movements by and between the brake beam guides on the side frames; and providing first and second brake heads in operable combination with and toward the first and second ends, respectively, of the brake beam subassembly for movements toward and away from the wheels as the guide members move within the brake beam guides on the side frames.

According to this aspect, removing the damaged brake beam involves the step of: disconnecting the brake rigging linkages extending from and connected to the damaged brake beam. Moreover, the step of removing the damaged brake beam involves the step of: dividing one or more of the individual components comprising the damaged brake beam assembly into pieces to facilitate removal of the damaged brake beam assembly while maintaining the railcar truck and car body in operable association with each other.

Preferably, the first guide, defining the first end of the brake beam subassembly, is formed as an integral part of the first brake head. According to this aspect, the preferred method further includes the step of: providing a series of aligned openings toward the second ends of the compression and tension members.

In one form, the second guide member is formed integral with and extends from one side of the second brake head. This preferred method can also include the step of: providing the second brake head with a flange portion extending laterally outward and on an opposite side from the second guide, with the flange portion defining a series of holes which align with the openings provided toward the second ends of the compression and tension members.

In a preferred methodology, fastening or coupling the second guide to the second end of the brake beam subassembly includes the step of: providing a series of fasteners configured to pass endwise through the series of holes in the flange portion of the second brake head and through the aligned openings toward the ends of the compression and tension members disposed opposite from the first end of the brake beam subassembly to permit the second guide and the brake beam subassembly to be coupled to each other whereby forming the rigid brake beam unit.

According to still another aspect, a method is provided for replacing a damaged brake beam connected to brake rigging linkages on a railcar having a car body supported on a railcar truck while maintaining the railcar truck and the car body in operable association with each other. The railcar truck includes first and second laterally spaced side frames for supporting an axle and wheels therebetween. Each of the side frames includes, on an inboard side thereof, a brake beam guide extending for a length at least equivalent to the extent of travel of the brake beam, and with the brake beam guides on the side frames being separated by a predetermined distance.

The method according to this aspect, involves the steps of: removing the damaged brake beam from between the side frames of the railcar truck while maintaining the railcar truck and car body in operable association with each other; arranging a first part of a replacement brake beam structure into operably supported and guided relation with the brake beam guide on the first side frame while maintaining the railcar truck and car body in operable association with each other, with the first part of the brake beam structure having an operative length shorter than the predetermined distance between the brake beam guides on the first and second side frames; arranging a second part of the replacement brake beam structure into supported and guided relation with the brake beam guide on the second of the side frames while maintaining the railcar truck and car body in operable association with each other, with the second part of the brake beam structure having an operative length shorter than the predetermined distance between the brake beam guides on the first and second side frames; securing or coupling the first and second parts of the replacement brake beam structure to each other to form a rigid assembly capable of withstanding the braking forces applied thereto during operation of the railcar and while maintaining the railcar truck and car body in operable association with each other, with the combined and joined operative lengths of the first and second parts of the replacement brake beam structure being substantially equivalent to the predetermined distance between the brake beam guides on the side frames; and providing a brake head in operable combination with each of the first and second parts of the replacement brake beam structure for movements toward and away from the wheels as the first and second parts forming the rigid assembly move within the brake beam guides on the side frames.

According to this aspect, removing the damaged brake beam involves the step of: disconnecting the brake rigging linkages extending from and connected to the damaged brake beam. Moreover, and according to this aspect, the step of removing the damaged brake beam involves the step of: shortening the operative length of the damaged brake beam to facilitate removal of the damaged brake beam while maintaining the railcar truck and the car body in operable association with each other.

According to this aspect, at least one of the first and second parts of the replacement brake beam structure includes an elongated compression member, an elongated and generally V-shaped tension member joined toward the ends thereof to the compression member, and a fulcrum disposed between the generally V-shaped tension member and the compression member. Moreover, the first and second parts of the replacement brake beam structure each preferably include an end extension configured for sliding accommodation with one of the brake beam guides on one of the first and second side frames. In one form, the each end extension provided on the first and second parts of the replacement brake beam structure is formed as a part of the first and second brake heads arranged in operable combination with each of the first and second parts of the replacement brake beam structure Preferably, and according to this aspect, the methodology further includes the step of: maintaining tension in the tension member and maintaining compression in the compression member before that part including the compression member and tension member is arranged in supported and guided relation with the respective brake beam guide on one of the side frames of the wheeled truck.

According to yet another aspect, a method is provided for replacing a damaged brake beam connected to brake rigging linkages on a railcar having a car body supported on a railcar truck while maintaining the railcar truck and the car body in operable association with each other. The railcar truck includes a pair of laterally spaced side frames for supporting an axle and wheels therebetween. Each of the side frames includes, on an inboard side thereof, a brake beam guide extending for a length at least equivalent to the extent of travel of the brake beam, and with the brake beam guides on the side frames being separated by a predetermined distance.

The method according to this aspect, involves the steps of: removing the damaged brake beam from between the side frames of the railcar truck while maintaining the railcar truck and car body in operable association with each other; providing a brake beam subassembly comprised of a compression member, an angled tension member, and a first brake head arranged toward a first end of the brake beam subassembly for securing a first end of the compression member and a first end of the tension member in fixed relation relative to each other, with the brake beam subassembly further including a first guide laterally extending beyond the joined ends of the compression and tension members to define the first end of the brake beam subassembly, with the brake beam subassembly having an operative length shorter than the predetermined distance between the brake beam guides on the side frames; arranging or positioning a free distal end of the first guide into one of the brake beam guides on one of the side frames while maintaining the railcar truck and car body in operable association with each other such that the first end of the brake beam subassembly is guided and supported for sliding movements by the side frame structure; providing a second brake head independent of the brake beam assembly, the second brake head including a second guide extending from one side thereof; arranging the second guide on the second brake head into guided and supported relation with the brake beam guide on other of the side frames while maintaining the railcar truck and car body in operable association with each other; and fastening the second brake head to a second end of the brake beam subassembly opposite from the first end while maintaining the railcar truck and car body in operable association relative to each other to form a rigid brake beam unit guided and supported for sliding movements by and between the brake beam guides on the side frames.

According to this aspect, removing the damaged brake beam involves the step of: disconnecting the brake rigging linkages extending from and connected to the damaged brake beam. In one form, the step of removing the damaged brake beam involves the step of: shortening one or more of the individual components comprising the damaged brake beam to facilitate removal of the damaged brake beam while maintaining the railcar truck and car body in operable association with each other. Preferably, the first guide is formed as an integral part of the first brake head.

The preferred methodology further includes the steps of: imparting a compression force to the compression member prior to arranging the free distal end of the first guide into one of the brake beam guides; and, imparting a tension force to the tension member prior to arranging the free distal end of the first guide into one of the brake beam guides. Moreover, a preferred methodology further includes the step of: securing the compression and tension members in predetermined positional relation relative to each other so as to maintain the compression forces in the compression member and the tension forces on the tension member. According to this aspect, the methodology furthermore preferably includes the step of: providing a series of aligned openings toward the second ends of the compression and tension members.

In one form, the second brake head is provided with a flange portion extending laterally outward and on an opposite side of the brake head from the second guide. The flange portion defines a series of holes which align with the openings provided toward the second ends of the compression and tension members. According to this methodology, fastening the second brake head to the second end of the brake beam subassembly includes the step of: providing a series of fasteners configured to pass endwise through the series of holes in the flange portion of the second brake head and through the aligned openings provided toward the second ends of the compression and tension members to permit the second brake head and second guide to be fastened to the brake beam subassembly whereby forming the brake beam unit.

According to still another aspect, there is provided a method for replacing a damaged brake beam truss connected to brake rigging linkages on a railcar having a car body supported on a railcar truck including a wheel and axle assembly having a pair of laterally spaced wheels mounted between a pair of laterally spaced side frames. Each side frame includes structure projecting laterally inwardly from an inboard side thereof for guiding and supporting the damaged truss assembly, and with the structure on the side frames defining a predetermined lateral distance therebetween.

This aspect involves the steps of: disconnecting the brake rigging linkages extending from and connected to the damaged brake beam truss; raising that end of the railcar body from operable association with that truck having the damaged brake beam truss thereon; wheeling that truck having the damaged brake beam truss thereon from beneath the raised end of the car body; removing the damaged brake beam truss from between the side frames of the railcar truck while maintaining the side frames in position relative to each other; arranging a first end-guide, defining a first end of a truss beam subassembly, into guided and supported sliding relation relative to the structure on one of the side frames, with the truss beam subassembly further including compression and tension members each having a first end secured to each other, and wherein the truss beam subassembly has an overall length shorter than the predetermined lateral distance between the structures on the side frame members; arranging a second end-guide into guided and supported sliding relation relative to the structure on the other of the side frames, with the second end-guide having a free distal end; securing the second end-guide to a second end of the truss beam subassembly opposite from the first end to form a rigid brake beam unit and such that the free distal ends of the end-guides are guided and supported for sliding movements between the structures on the side frames of the railcar truck; and providing first and second brake heads in operable combination with and toward the first and second ends, respectively, of the truss beam subassembly for movements toward and away from the wheels on the wheel and axle assembly as first and second end-guides slidably move within the structures on the side frames.

Preferably, the first end-guide defining the first end of the brake beam truss subassembly is formed as an integral part of one of the brake heads on the brake beam unit. A preferred methodology further includes the step of: providing a series of aligned openings toward second ends of the compression and tension members disposed opposite from that end of the brake beam truss subassembly which carries the first end-guide.

According to this aspect, the methodology further includes the step of: imparting a compression force to the compression member prior to arranging the first end-guide into guided and supported sliding relation relative to the structure on one of the side frames; and, imparting a tension force to the tension member prior to arranging the first end-guide into guided and supported sliding relation relative to the structure on one of the side frames. Preferably, the method further includes the step of: securing the compression and tension members in fixed position relative to each other toward the second end of the brake beam truss subassembly. Preferably, the second end-guide is formed as an integral part of and extends from one side of the brake head on the brake beam unit disposed opposite from the first end-guide.

Preferably, the methodology further includes the step of: providing the brake head, having the second end-guide formed as an integral part thereof, with a flange portion extending laterally outward and on an opposite side from the second end-guide. The flange portion defines a series of holes which align with the openings provided toward the second ends of the compression and tension members. According to this aspect, the step of securing the second end-guide to the truss beam subassembly further includes the step of: providing a series of fasteners configured to pass endwise through the series of holes in the flange portion of the brake head with the second end-guide formed as an integral part thereof and through the aligned openings toward the second ends of the compression and tension members to secure the second end-guide to the brake beam truss subassembly form the rigid brake beam unit.

A primary feature of the present disclosure relates to the substantial reduction in time the railcar having a damaged brake beam assembly is taken out of rail service before a replacement truss-type brake beam assembly can be arranged in operable association therewith.

Another feature of the present disclosure relates to the reduction and simplification in the number of steps required to accomplish replacement of a damaged brake beam assembly with a replacement truss-type brake beam assembly.

Still another feature of the present disclosure relates to the vast reduction in the number of special tools and equipment required for effecting replacement of a damaged or condemned brake beam assembly.

Another feature of the present disclosure relates to the provision of a new and novel methodology for replacing damaged or condemned railcar brake beam assemblies with replacement truss-type brake beams offering equal if not superior performance characteristics to that truss-type brake beam assembly being replaced.

Still another feature of the present disclosure relates to a method of replacing a condemned brake beam assembly on a railcar with a brake beam assembly including tension and compression members arranged in a truss-like relationship relative to one another in a shortened period of time and, thus, at less costs than heretofore known brake beam replacements processes.

These and other objects, aims, and advantages will become more readily apparent from the following detailed description, appended claims, and drawings.

DETAILED DESCRIPTION OF THE DRAWINGS

FIG. 7 is a plan view showing the brake beam truss subassembly in operative association with one of the railcar trucks;

FIG. 8 is a plan view of an end-guide used in connection with the present disclosure;

FIG. 9 is a left side elevational view of the end-guide shown in FIG. 7;

DESCRIPTION OF THE INVENTION

Figure 1:
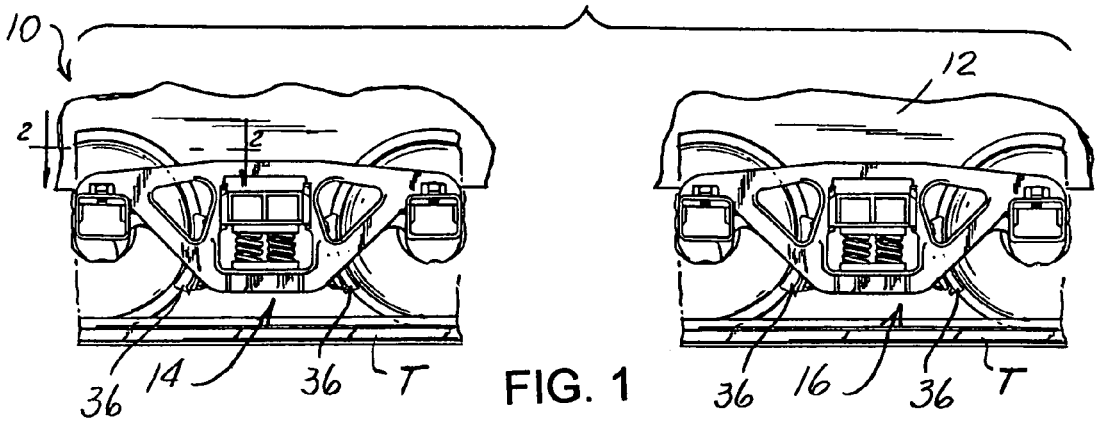
FIG. 1 is a fragmentary side elevational view of a railroad car having railroad car trucks arranged toward opposite ends thereof.

While the present disclosure is susceptible of embodiment in multiple forms, there is shown in the drawings and will hereinafter be described preferred embodiments, and the present disclosure is to be considered as setting forth exemplifications which are not intended to limit the disclosure to the specific embodiments illustrated and described.

Referring now to the drawings, wherein like reference numerals indicate like parts throughout the several views, FIG. 1 shows a railroad car 10 including a car body 12. As is known, car body 12 is supported, toward opposite ends thereof, in operable combination with a pair of wheeled trucks 14 and 16 for movement over tracks T. The wheeled trucks 14 and 16 are substantially similar to each other and, thus, only wheeled truck 14 will be discussed in detail.

Figure 2:
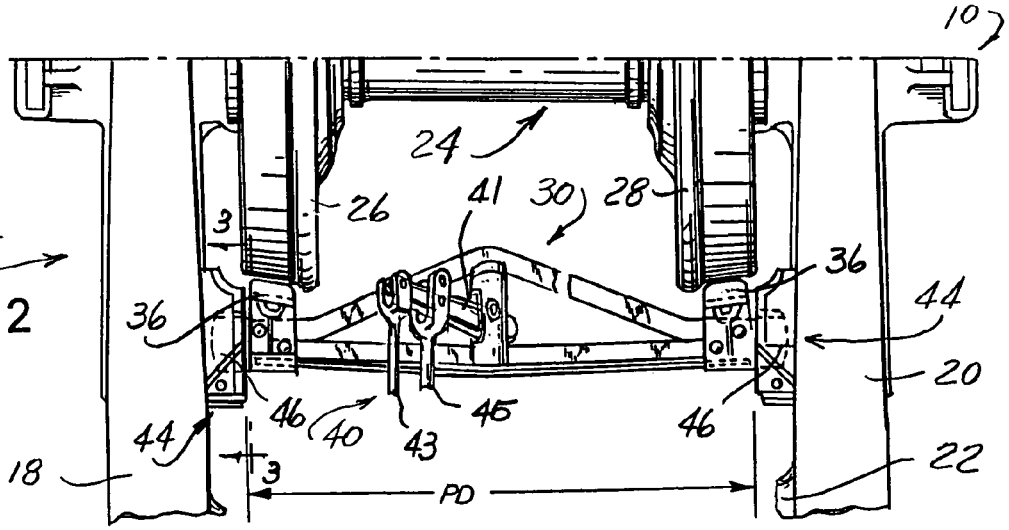
FIG. 2 is a fragmentary plan view taken along line 2-2 of FIG. 1.

As shown in FIG. 2, each wheeled truck includes a pair of side frames 18 and 20 with a bolster 22 extending laterally therebetween and upon which car body 12 (FIG. 1) is supported. The side frames 18, 20 are usually of one-piece construction and formed from cast steel. Although only one is partially shown in FIG. 2, those skilled in the art will appreciate a conventional wheel and axle assembly 24 is provided on each side of the bolster 22 between the side frames 18, 20 and in operable combination with each truck. As is typical, each wheel and axle assembly 24 includes a pair of laterally spaced and flanged wheels 26 and 28.

Each wheel and axle assembly 24 on car 10 has a brake beam 30 arranged in operable combination therewith. As shown in FIG. 2, a conventional brake beam 30 includes several interrelated components configured in a truss-like configuration and laterally extends between the two side frames 18 and 20 for guided movements. As is typical, each brake beam 30 has brake shoes 36 disposed toward opposed ends thereof for engagement with the respective wheels 26, 28 of an associated wheel and axle assembly. The brake shoes 36 are moved into and out of braking relation with the wheels 26, 28 of a respective wheel and axle assembly through brake rigging, generally identified in FIG. 2 by reference numeral 40, responsive to operation of an air cylinder (not shown) or a hand brake mechanism (not shown).

Figure 3:
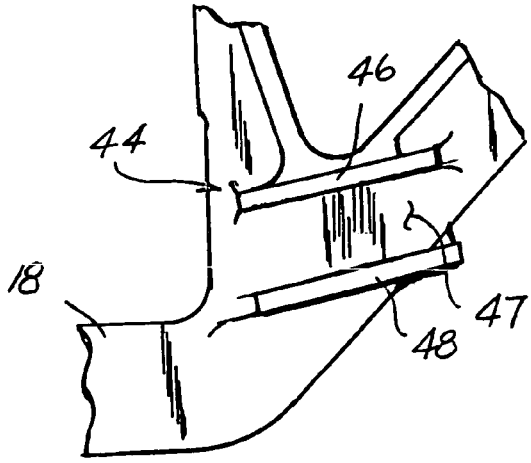
FIG. 3 is a fragmentary side view taken along line 3-3 of FIG. 2.

The side frames 18, 20 on each truck include structure 44 for guiding and supporting the brake beam 30. As shown in FIG. 3, structure 44 typically includes a pair of spaced guides or flanges 46 and 48 usually formed integral with and extending from an inboard side of each side frame to define an open sided channel-like recess 47 therebetween for slidably receiving and accommodating one end of the brake beam assembly. Each channel-like recess 47 extends for a length at least equivalent to the extent of travel of the brake beam 30 (FIG. 2). In the specific form shown in FIG. 3, guides 46 and 48 are configured such that the recess 47 slants upwardly toward the axis of the respective wheel and axle assembly and relative to a generally horizontal plane. Suffice it to say, and as shown in FIG. 2, the free ends of the guides 46, 48, i.e., that end opening to the recess 47, on the side frame 18, 20 are laterally separated from each other by a predetermined lateral distance PD.

As mentioned, a typical railcar sometimes travel tens of thousands of miles over railbeds that can be in something less than a desirous condition. Accordingly, an undercarriage of the rail car is often subjected to unknown or unforeseen objects as it travels between locations. As a result, the brake beam assembly 30 is often times damaged. As used herein and throughout, the term "damaged brake beam assembly" means and refers to any one or more of the component parts comprising the brake beam assembly 30 being broken, lacking structural integrity, cracked, torn, twisted, worn out, bent, disfigured, deteriorated, missing, wrong (not standard to car) dislocated, ruined, or any other condition which would warrant condemnation and/or replacement of the brake bream assembly 30.

According to one method, the process for replacing a damaged brake beam includes the step of: removing the damaged brake beam 30 from between the side frames 18, 20 of the respective railcar truck while maintaining the respective railcar truck 14, 16 and car body 12 in operable combination (FIG. 1). The step of removing the damaged brake beam can furthermore involve the step of: disconnecting from the damaged brake beam 30 those linkages forming part of the brake rigging 40. Although not necessarily all inclusive, "brake beam linkages" means and refer to either a "live" or "dead" lever 41 (FIG. 2) carried by the brake beam 30, a top rod 43 extending from and connected to lever 41, a truck lever connection 45 connecting lever 41 with a like lever on the brake beam on the opposite side of the respective wheel and axle assembly, as well as those pins and the like defining the multitude of articulate connections between the various rods, levers and connections of the brake rigging 40. Moreover, lever 41 is typically disconnected or removed from operable association with the brake beam 30 to be replaced.

In one form, removing the damaged brake beam 30 furthermore involves: dividing one or more of the individual components comprising the damaged brake beam assembly 30 into shortened pieces to facilitate removal of the damaged brake beam from between the side frames 18, 20 while maintaining the railcar truck and car body 12 in operable combination with each other. Preferably, the compression and tension members of the damaged brake beam are severed or cut as through use of a cutting torch or the like. It will be appreciated, however, any other method for shortening the damaged brake beam assembly to facilitate its removal from between the side frames 18, 20 could likewise be used for effecting the desired ends without detracting or departing from the broad spirit and scope of the present disclosure.

The method of replacing the damaged brake beam also involves: arranging a first part of a replacement brake beam structure into supported and guided relation with the brake beam guide or structure 44 provided on one of the side frames 18, 20. In the exemplary embodiment, the first part of the replacement brake beam structure comprises a brake beam subassembly, generally identified in FIG. 4 by reference numeral 50. The brake beam subassembly 50 is preferably configured as a truss structure which, in one form, comprises a rectilinear compression member or bar 52 and a tension member or bar 62. Member 52 has any desirable cross-section but is shown having a generally L-shaped cross-section extending substantially the entire length of member 52 and includes joined legs 53 and 55. As will be appreciated, different cross-sectional shapes will afford member 52 with different amounts of columnar strength per unit weight. A square tubular shape, or a rectangular tubular shape, or a generally C-shape can also give good results. A cruciform shape also renders relatively good results.

In the illustrated form, legs 53 and 55 of member 52 are disposed at a right angle relative to each other. Preferably, each leg 53, 55 has a thickness ranging from 0.1 inches to about 0.5 inches and, most preferably, from about 0.2 inches to about 0.4 inches. Preferably, each leg 53, 55 of member 52 has a width ranging between about 1.5 inches and about 5.0 inches and, most preferably, from about 2 to about 4 inches. In one form, member 52 is formed from a material having a yield strength of from about 20,000 to about 100,000 pounds per square inch and, most preferably, from about 30,000 to about 60,000 pounds per square inch. Member 52 is preferably fabricated from carbon steel with a carbon content ranging between about 0.05 to about 0.5 percent. Preferably, member 52 has an elongation at break of at least about eight percent and, most preferably, at least about 12 percent. In one form, and except for the specified length, member 52 is configured in accordance with the disclosure in U.S. Pat. No. 5,810,124 to M. R. Sandmann; the applicable portions of which are incorporated herein by reference.

In the illustrated embodiment, tension member 62 preferably has a substantially "flat" cross-sectional configuration with divergent halves 63 and 65 extending from a center bend 64 to provide member 62 with the general form of a wide V or angle and such that member 62 has a maximum depth toward a mid-portion thereof. Here again, tension member 62 is configured in substantial accordance with the disclosure in coassigned U.S. Pat. No. 5,810,124 to M. R. Sandmann; the applicable portions of which are incorporated herein by reference. Suffice it to say, and toward the ends thereof, halves 63 and 65 of member 62 are each seated against leg 53 of the compression member 52.

In the illustrated embodiment, brake beam subassembly 50 also includes a strut or fulcrum 70 disposed between the midsection of the compression member 52 and the apex or bend 64 of tension member 62 for maintaining tension in member 62 and camber in member 52 during operation of the railcar. Strut 70 has a conventional and well known design. Suffice it to say, strut 70 is preferably hollow lengthwise, the same having opposite side walls 72, 72' defining a longitudinal slot 74. Toward a longitudinal center thereof, strut 70 preferably includes structure 76 for pivotally supporting a linkage, i.e. truck lever 41 forming part of the brake rigging 40 (FIG. 2). In the illustrated embodiment, and when secured between members 52 and 62, strut 70 is inclined laterally to conform to the required inclination and position of the truck lever to be arranged in operable combination therewith. It should be appreciated, however, the disposition of the longitudinal slot 74 and structure 76 defined by the fulcrum or strut 70 can be other than that shown and disclosed without detracting or departing from the spirit and scope of the disclosure.

Members 52, 62 of subassembly 50 are secured to each other toward one end thereof through any suitable means. In the embodiment illustrated in FIG. 4, a series of conventional fasteners 78 fixedly secure a first end of the compression member 52 to a first end of the tension member 62. The fasteners 78 can be of any suitable type including rivets, or huck bolts, or other two-piece fasteners approved by the AAR, including an elongated threaded fastener and threaded nut combinations using a cotter key, or a nylon insert on either the threads of the elongated bolt or nut, or a conventional stake nut arrangement, or spot welding of the nut.

Figure 4:
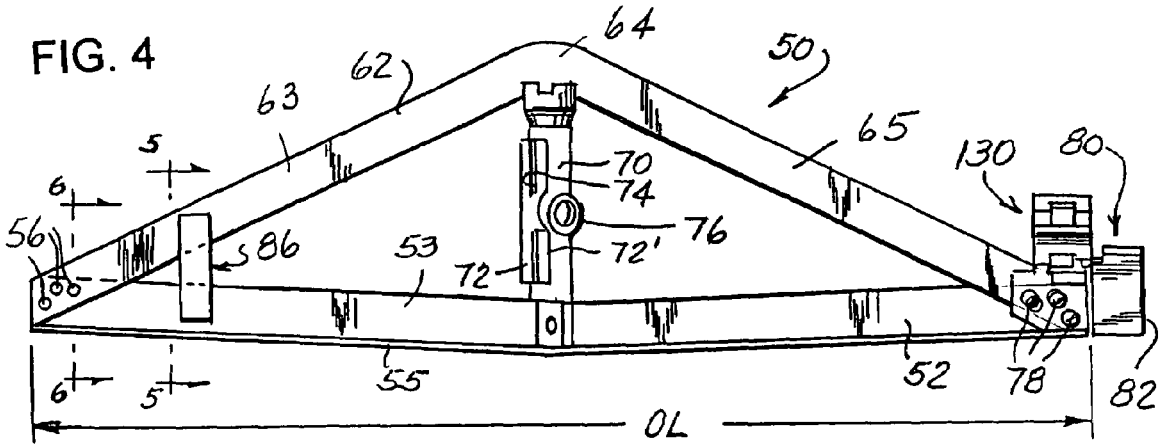
FIG. 4 is a plan view of a brake beam truss subassembly used in connection with the present disclosure.

As shown in FIG. 4, subassembly 50 further includes an end-guide 80 projecting laterally outward from the secured ends of members 52 and 62 to define a first end of the brake beam subassembly 50. Preferably, guide 80 has a free distal end 82 to facilitate its insertion into operable combination with the structure 44 on one of the side frames 18, 20 of the wheeled truck 14 (FIG. 3). That is, guide 80 is configured to slidably fit into and, thus, support one end of the subassembly 50 for linear reciprocation within one of the inclined channels or recesses 47 defined by the structure 44 on the side frames 18, 20 of the wheeled truck 14 (FIG. 3).

In a preferred embodiment, and after members 52 and 62 are secured together toward their first ends, forces are applied to the subassembly 50 by known means, i.e., clamps or other suitable and well known devices, to preferably establish compression and tension forces in members 52 and 62 of subassembly 50. As should be appreciated, the fasteners 78 maintain the first ends of members 52 and 62 a predetermined positional relationship relative to each other.

Figure 5:
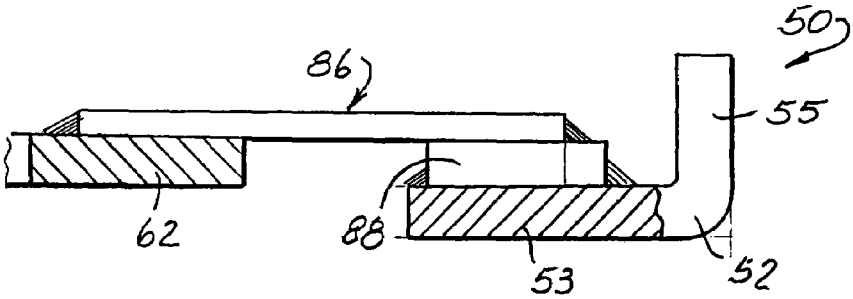
FIG. 5 is a sectional view taken along line 5-5 of FIG. 4.

In one form, another step in the process preferably includes maintaining compression and tension forces in members 52 and 62 after subassembly 50 is operably removed from such clamps importing such forces thereto. In one form, and after applying suitably directed forces to subassembly 50 so as to create compression and tension in members 52 and 62, respectively, and as shown in FIGS. 4 and 5, a strap or other suitable connector 86 extends between and is secured adjacent to the second ends of both the tension member 62 and leg 53 of compression member 52. Preferably, strap or connector 86 is spot welded or otherwise suitably secured adjacent to the second ends of members 52, 62 so as to positively maintain the second ends of members 52, 62 in predetermined positional relation relative to each other. As such, and after the clamping devices used to import forces to members 52 and 62 are removed therefrom, the ends of members 52, 62 are maintained in predetermined position relative to each other whereby allowing member 52 to preferably maintain a predetermined level of compression between the opposed ends thereof while member 62 also preferably maintains a predetermined level of compression between the first and second ends thereof. In the exemplary embodiment shown in FIG. 5, and to compensate for the differences in height between member 62 and leg 53 of member 52, a suitable spacer 88 can be provided in operable combination with the strap or connector 86.

Figure 6:
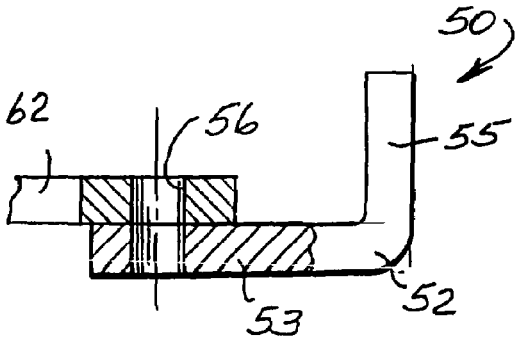
FIG. 6 is a sectional view taken along line 6-6 of FIG. 4.

As shown in FIG. 6, and after members 52 and 62 are secured relative to each other toward their second ends by the connector or strap 88 (FIGS. 4 and 5), a series of holes or openings 56 are provided in members 52 and 62. Notably, the holes or openings 56 pass entirely through both the compression member 52 and tension member 62. As shown in FIG. 4, the holes or openings 56 in members 52, 62 are arranged in a predetermined pattern relative to each other and such that a closed margin of each opening 56 is defined within parameters defined by the respective members 52 and 62. In one form, the holes or openings 56 are drilled or otherwise concurrently provided through both members 52 and 62 such that alignment is affected and is preferably maintained between the holes 56 in both members 52 and 62.

Turning to FIG. 7, and after the free end of the fixed guide 80 on the brake beam subassembly 50 is arranged in guided and supported relation with the side frame structure 44 on side frame 20, the brake beam subassembly 50 has a predetermined overall or operative length OL. It is important to note, however, the operative length OL of the brake beam subassembly 50 is shorter than the predetermined distance PD between the guide structure 44 on the opposed inner surfaces of the side frames 18, 20. Configuring the operative length OL of the brake beam subassembly 50 shorter than the predetermined distance PD between the guide structure 44 on the opposed inner surfaces of the side frames 18, 20.yields a very important advantage. That is, and by so configuring the brake beam subassembly 50, the free end of guide 80 on the brake beam subassembly 50 can be inserted into operable combination with the side frame structure 44 used to support and guide same without having to pry the side frames 18, 20 apart from each other, and according to one method of the present disclosure, while maintaining the car body 12 (FIG. 1) in operable association with that wheeled truck wherein the brake beam is being replaced.

According to one method, the process for replacing the damaged brake beam furthermore includes the step of: arranging a second part of the replacement brake beam structure into supported and guided relation with the brake beam guide or structure 44 provided on other one of the side frames 18, 20. In the illustrated embodiment, this step involves arranging a second end-guide 90, independent of end-guide 80, in guided and supported sliding relation relative to structure 44 on the other side frame 20 of that wheeled truck wherein the damaged brake beam is being replaced. As shown in FIG. 8, the second end-guide 90 has a free end 92 configured for insertion and into operable combination with structure 44 on the side frame 18 of truck 14 (FIG. 2). Guide 90 is configured to promote guided reciprocatory, sliding movements thereof within the channel 47 defined by structure 44 on frame 18. As shown in FIG. 9, and like guide 80, guide 90 is preferably configured with a blind cavity 93 opening to the distal end 92 to reduce the weight of the respective guide.

Figure 10:
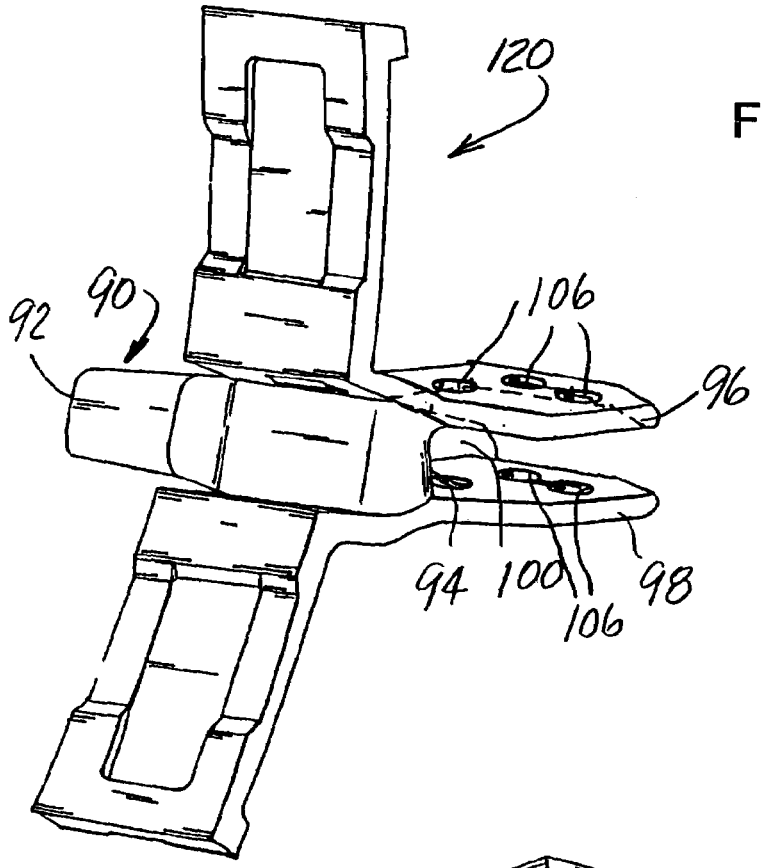
FIG. 10 is a perspective view of the end-guide shown in FIG. 7.
Figure 11:
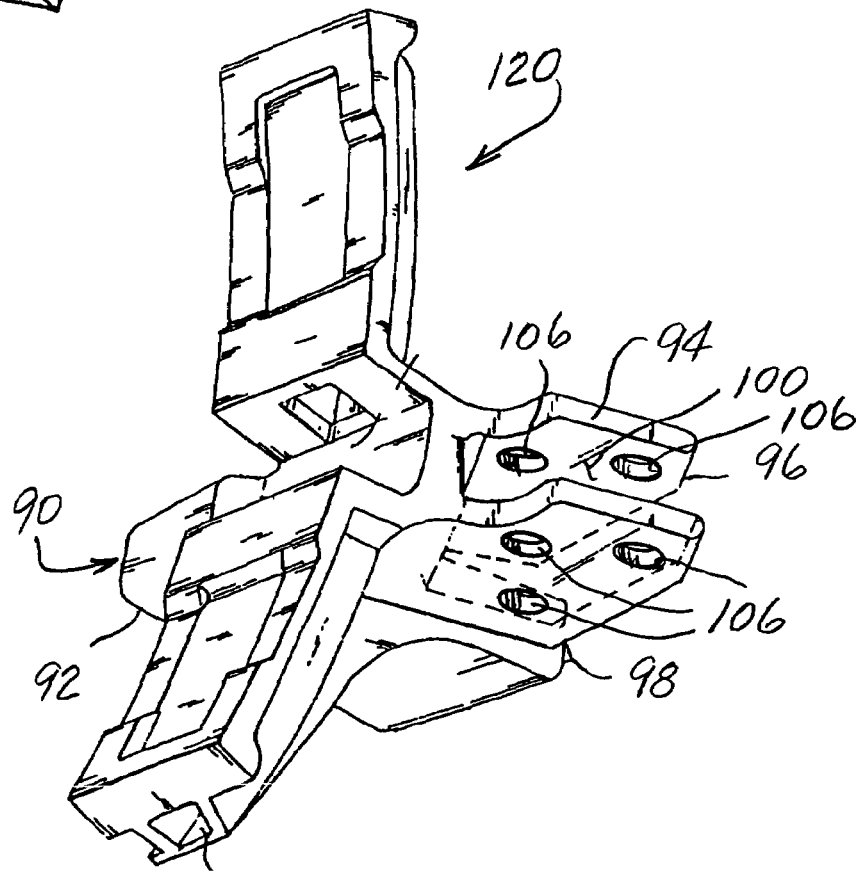
FIG. 11 is another perspective view of the end-guide shown in FIG. 7.

After the first and second parts of the replacement brake beam truss assembly are both arranged in supported and guided relation relative to the respective structure 44 on the side frames 18 and 20 of the wheeled truck 16, the first and second parts comprising the primary components of the replacement brake beam truss assembly are secured or coupled to each other to form a rigid assembly capable of withstanding braking forces applied thereto during operation of the railcar. In the embodiment shown in FIGS. 8, 10 and 11, and to promote the step of fastening or securing the second end-guide 90 to the second end of the brake beam subassembly 50, opposite from guide 80, flange structure 94 is arranged in operable combination with the end-guide 90 and is axially spaced from the free distal end 92 thereof. In one form, flange structure 94 includes a pair of spaced flanges 96 and 98 defining a C-shaped or open sided channel 100 therebetween. The flanges 96, 98 of structure 94 each define a series of axially aligned holes or openings 106 passing entirely through each flange 96, 98. Notably, the holes or openings 106 each have a closed margin defined by flange structure 94 and are arranged in a predetermined pattern relative to each other. In the illustrated embodiment, the pattern defined by the holes or openings 106 in flange structure 94 corresponds to the pattern defined by the openings 56 defined toward the second ends of members 52 and 62 of the brake beam subassembly 50.

Figure 12:
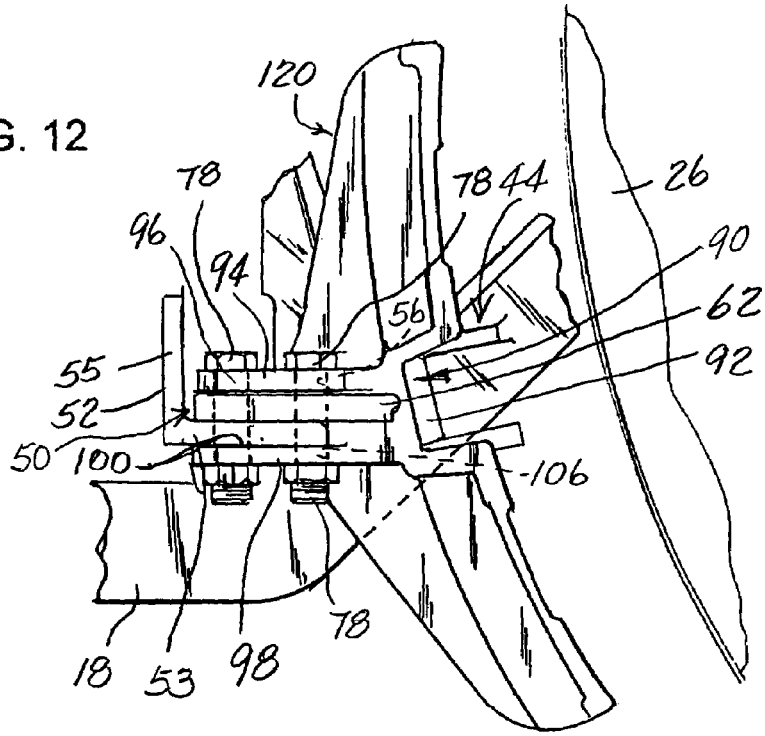
FIG. 12 is a right side partial view of a free end of the brake beam truss subassembly arranged in operable association with the end-guide shown in FIG. 7.

As shown in FIG. 12, and with the second end-guide 90 arranged in guided and supported sliding relation relative to the structure 44 on the side frame 20 of that wheeled truck wherein the damaged brake beam is being replaced, the second ends of the compression member 52 and tension member 62, disposed opposite from the first end-guide 80 (FIG. 4), are slidably inserted into the open sided channel 100 defined between flanges 96 and 98 of flange structure 94. After the free ends of the compression member 52 and tension member 62 are slidably inserted into the open sided channel 100, another series of conventional fasteners 78 are passed endwise through aligned openings 56 and 106 in members 52, 62 and flange structure 94, respectively.

Figure 13:
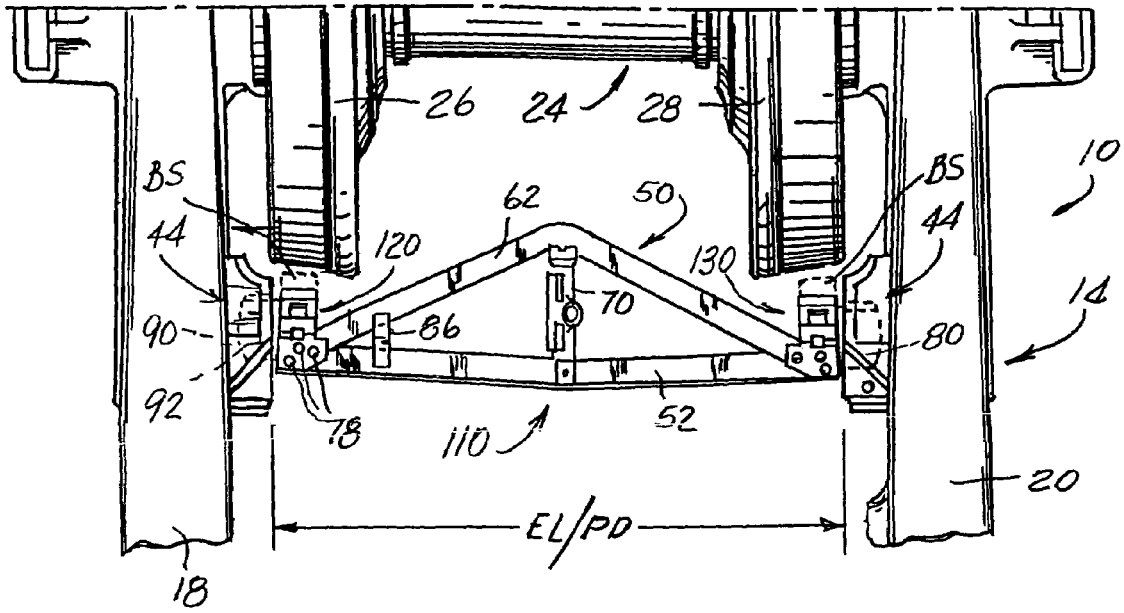
FIG. 13 is a plan view similar to FIG. 7 but showing an assembled brake beam unit in operative association with one of the railcar trucks.

Preferably, and after assembling or coupling the second-guide 90 to the second ends of the compression member 52 and tension member 62, each fastener 78 is torqued to a predetermined setting or tightness whereby securing the second end-guide 90 to the brake beam subassembly 50 to form a rigid brake beam unit, designated generally by reference numeral 110 in FIG. 13. As shown in FIG. 13, with the second end-guide 90 secured to the brake beam subassembly 50, and with the free ends 82 and 92 of guides 80 and 90, respectively, inserted into operable combination with the guide structure 44 on the associated side frames 18, 20, the resultant brake beam unit 110 has an effective length EL substantially equal to the predetermined distance PD between the guide structure 44 on the opposed inner surfaces of the side frames 18, 20 of the wheeled truck 14 requiring a replacement brake beam.

The process of replacing the brake beam structure also includes the step of: providing first and second brake heads 120 and 130, respectively, in operable combination with and toward the first and second ends, respectively, of the brake beam subassembly 50 for movements toward and away from the wheels 26, 28 on the wheel and axle assembly 24 as the first and second end-guides 80, 90 of the brake beam unit 110 slidably move within the structure 44 on the side frames 18, 20. In one form, the first end-guide 80, defining one end of the brake beam subassembly 50, is formed as an integral part of the first brake head 120. In the embodiment shown in FIG. 4, guide 80 is formed integral with and extends from one lateral side of the brake head 120. Suffice it to say, the brake head 120 illustrated in FIG. 4, is configured in substantial accordance with the Association of American Railroads "Manual of Standards and Recommended Practices", Section D, Trucks and Tracks Details, Standard S-345-79 (Adopted 1875, Revised, 1979), Application Tolerances for Brake Beams, Hangerless Types; the applicable portions of which are incorporated herein by reference.

Similarly, and in the exemplary embodiment, guide or end extension 90 is formed as an integral part of the second brake head 130. In the embodiment illustrated in FIG. 8, guide 90 extends from one lateral side of the second brake head 130.

The flange structure 94, operably associated with guide 90, is preferably formed integral with and extends from an opposite lateral side of brake head 130. Suffice it to say, the brake head 130 illustrated in FIG. 8, is likewise configured in substantial accordance with the above-mentioned Association of American Railroads "Manual of Standards and Recommended Practices".

Without being bound or limited to any specific design, each brake head 120, 130 is suitably configured to allow or permit a brake shoe BS (FIG. 13) to be connected thereto. To maximize the clearance between the brake heads 120, 130 and the wheels 26, 28 of the wheel and axle assembly 24 and, thus, minimizing the time required to affect replacement of the damaged brake beam, the brake shoes BS are preferably arranged in operable combination with each brake head 120, 130 after the brake beam unit 110 is arranged in operable association with the guide structure 44 on the side frames 18, 20 of the wheeled truck 14, 16.

In accordance with another method, the process for replacing a damaged brake beam truss 30 on a railcar of the above-described type involves: disconnecting linkages of the brake rigging 40 from the damaged brake beam truss 30. This alternative process further involves lifting the end of the railcar body 12 arranged in operable association with that truck 14, 16 having the damaged brake beam truss thereon. Raising the end of the car body 12 allows the truck 14, 16 having the damaged brake beam truss 30 to be wheeled or rolled from therebeneath.

Having wheeled the truck 14, 16 with the damaged brake beam 30 thereon from beneath the raised railcar body 12, the damaged brake beam truss 30 is removed from between the side frames 18, 20 of the railcar truck 14, 16. Removing the damaged brake beam truss 30 from between the side frames 18, 20 can be affected in the same manner described above or any other suitable manner not requiring separation or lateral prying of the side frames 18, 20 in opposed lateral directions relative to each other.

After removing the damaged brake beam truss 30, the first apart of the replacement brake beam or, in the illustrated embodiment, the first end-guide 80 of subassembly 50, is arranged in guided and supported sliding relation relative to structure 44 on side frame 18. As mentioned above, the truss beam subassembly 50 includes members 52 and 62. Both members 52, 62 have an end secured to each other by the first end-guide 80. As mentioned above, beam subassembly 50 has an overall or operative length OL shorter than the predetermined lateral distance PD between the free ends of the structure 44 on the side frames 18 and 20, thus, permitting end-guide 80 to be inserted into guided and supported relation with structure 44 on side frame 18 and the remainder of the subassembly to be positioned between the structure 44 on the side frames 18 and 20 without having to laterally pry or increase the lateral spacing between the side frames 18, 20.

This alternative process further involves the step of: arranging the second part of the replacement brake beam, or in the embodiment illustrated, guide 90 in operably guided and supported sliding relation with the structure 44 on the side frame 20. Notably, the free distal end 92 of guide member 90 is configured to be slid into and thereafter slidably accommodated with the recess 47 defined by structure 44.

After guide 90 is arranged in guided and supported sliding relation with the structure 44 on side frame 18, the second part of the replacement brake beam, i.e., guide 90, is secured to the first part of the replacement brake beam, i.e., subassembly 50, to form a rigid brake beam unit 110 and such that the free distal ends 82 and 92 of the end-guides 80 and 90, respectively, are guided and supported for sliding movements between and by the structure 44 on the side frames 18, 20 of the railcar truck.

An additional step in this alternative process involves: providing the first and second brake heads 120, 130 in operable combination with and toward the first and second ends of the subassembly for movements toward and away from the wheels 26, 28 on the wheel and axle assembly 24 as the first and second end-guides 80 and 90, respectively, slidably move within and are guided by the structure 44 on the side frames 18, 20.

Thereafter, the wheeled truck 14, 16 having the brake beam unit 110 arranged in operable combination with the wheel and axle assembly 24 is wheeled under the raised end of the railcar body 12. Then, the raised railcar body 12 is lowered into operable association with the bolster 22 and the railcar 10 is prepared for continued service.

Either and both of the two above-mentioned methods offer many advantages in replacing a damaged brake beam truss on a railcar which have been heretofore unknown. That is, with either of the methods described above, removing the damaged brake beam 30 from between the side frames 18, 20 of the respective wheeled truck while either maintaining the wheel and axle assembly 24 in operable combination with the side frames 18, 20 or while maintaining the relevant wheeled car truck in operable combination with the railcar body eliminates several steps in the heretofore known damaged brake beam replacement process. More specifically, removing the damaged brake beam 30 from between the side frames 18, 20 of the respective wheeled truck while either maintaining the wheel and axle assembly 24 in operable combination with the side frames 18, 20 or while maintaining the relevant wheeled car truck in operable combination with the railcar body eliminates the need to raise one end of each side frame out of operable engagement with the wheeled axle assembly 24, thus, yielding economies which are heretofore unavailable with heretofore known brake beam replacements processes.

Removing the damaged brake beam 30 from between the side frames 18, 20 of the respective wheeled truck while either maintaining the wheel and axle assembly 24 in operable combination with the side frames 18, 20 or while maintaining the relevant wheeled car truck in operable combination with the railcar body eliminates the need to guard against inadvertent displacement of and, thus, prevent potential damage to the wheel bearing adapter disposed between each side frame 18, 20 and wheel assembly 24.

Furthermore, removing the damaged brake beam 30 from between the side frames 18, 20 of the respective wheeled truck while either maintaining the wheel and axle assembly 24 in operable combination with the side frames 18, 20 or while maintaining the relevant wheeled car truck in operable combination with the railcar body eliminates the heretofore known required step of having to spread the side frames 18, 20 laterally apart from each other to affect removal of the damaged brake beam. Besides saving the physical efforts required to affect such lateral displacement of the side frames 18, 20 relative to each other to affect removal of the damaged brake beam assembly 30, maintaining the wheel and axle assembly 24 in operable combination with the side frames 18, 20 or while maintaining the relevant wheeled car truck in operable combination with the railcar body substantially eliminates the potential of damaging the bearings associated with the other wheel and axle assembly on the wheeled truck having the brake beam assembly 30 requiring replacement.

As will be readily apparent to those skilled in the art, the above-described method of replacing a damaged brake beam on a wheeled truck of a railcar while maintaining the railcar body and wheeled truck in operable combination relative to each other yields still further benefits over heretofore known processes. In the above-described process, replacing the damaged brake beam can be effected without having to raise or separate the railcar body from the wheeled truck. Thus, the methodology set forth above eliminates the heretofore required and somewhat cumbersome hydraulic jacks, related hydraulic conduits, along with a suitable hydraulic pressure source.

One of many salient features of the present disclosure relates to the concept of providing first and second individual parts, each having an operative length OL which is shorter than the predetermined distance PD between the structure 44 on the inboard sides of the side frames 18, 20 but which when joined, fastened, coupled or otherwise secured to each other have an operative length equivalent to the predetermined distance between the structure 44 on the inner faces of the side frames 18, 20. Because of such design, and after the condemned brake beam has been removed, one end of the first part, i.e., subassembly 50, can be inserted into guided and supported relation with the guide structure 44 on one of the side frames 18, 20. Thereafter, the second part of the resultant assembly or unit, i.e., the second guide 90, forming the remainder of the effective length of the brake beam unit 110 can be arranged, independent of the subassembly 50, into guided and supported relation with the guide structure 44 on the other of the two side frames 18, 20. Thereafter, it is a simple matter of securing the second end-guide 90 and the second or free end of the subassembly 50 to form the brake beam unit 110.

In addition to the above, brake heads 120, 130 are provided in operable combination with the brake beam unit 110. As will be appreciated, the brake heads 120, 130 provide the brake beam unit 110 with mountings onto which suitable brake shoes BS are secured for braking engagement with the wheels 26, 28 on the respective wheel and axle assembly 24. In a most preferred embodiment, the first and second guides 80, 90 at opposed ends of the brake beam unit 110 are formed integral with the brake heads 120, 130.

Especially noticeable with the first of the two above described processes is the time saving yielded by the present disclosure. As will be appreciated, and besides eliminating those concerns mentioned above, there is considerable time savings involved with not having to both raise and lower the car body 12 to allow positioning of the respective wheeled truck relative thereto. Moreover, the subassembly design of the present disclosure yields considerable time savings in not requiring lateral separation of the side frames 18, 20 to effect either removal of the condemned brake beam 30 or insertion of the new brake beam unit 110 into operable combination with the relevant wheel and axle assembly 24. In a preferred form, the brake beam subassembly 50 is configured to permit both the compression member 52 and the tension member 62 to be imported with compression and tension forces , respectively, to maximize effectiveness and efficiency of the brake beam unit 110 during operation thereof.

Importantly, and especially with the first of the above-two described methods, considerable time savings are realized by not having to necessarily separate the railcar with the condemned brake beam from the remainder of the train consist. That is, the first of the above-two described methods lends itself to effecting replacement of the condemned brake beam assembly in the field and with the railcar remaining an integral part of the train consist. Accordingly, the time heretofore spent in separating or cutting the railcar with the condemned brake beam assembly from the remainder of the train consist is saved through the methodology of the present disclosure. The time heretofore spent in having to separately transport the railcar with the condemned brake beam assembly to a repair facility is also saved through practice of the present disclosure. The time heretofore spent in having to search for and locate a repair facility having the time to affect the necessary replacement of the defective brake beam assembly is also furthermore saved through practice of the present disclosure. Additionally, and since replacement of the condemned brake beam assembly can be affected without having to separate or cut the respective car from the remainder of the train consist, the time spent in having to reschedule delivery of that particular car to a predetermined destination can be saved through practice of the present disclosure.

From the foregoing, it will be observed that numerous modifications and variations can be made and effected without departing or detracting from the true spirit and novel concept of the present disclosure. Moreover, it will be appreciated, the present disclosure is intended to set forth exemplifications which are not intended to limit the disclosure to the specific embodiment illustrated. Rather, this disclosure is intended to cover by the appended claims all such modifications and variations as fall within the spirit and scope of the claims.

What is claimed is:

1. A method for replacing a damaged brake beam truss assembly connected to brake rigging linkages on a railcar having a car body supported on a railcar truck while maintaining said railcar truck and said car body in operable association with each other, said railcar truck including a wheel and axle assembly including a pair of laterally spaced wheels mounted between a pair of laterally spaced side frame members, with each side frame member including structure projecting laterally inwardly from the respective side frame member for guiding and supporting said brake beam truss assembly, and with the structure on said side frame members defining a predetermined lateral distance therebetween, said method comprising the steps of:

removing said damaged brake beam truss assembly from between said side frame members of said railcar truck while maintaining said railcar truck and said car body in operable association with each other;

arranging a first end-guide, defining a first end of a truss beam subassembly, into operably guided and supported sliding relation relative to the structure on one of said side frame members of the railcar truck, with said truss beam subassembly further including compression and tension members each having a first end secured to each other, and wherein the truss beam subassembly has an overall length shorter than the predetermined lateral distance between the structures on said side frame members so as to allow said truss beam subassembly to be arranged in operable combination with said structure on said one of said side frame members while maintaining said railcar truck and said car body in operable association with each other, and with said first end-guide having a free distal end;

arranging a second end-guide in operably guided and supported sliding relation relative to the structure on the other of said side frame members of the railcar truck, with said second end-guide haying a free distal end;

coupling said second end-guide and a second end of said truss beam subassembly opposite from said first end-guide to each other to form a rigid brake beam unit and such that the free distal ends of the end-guides are guided and supported for sliding movements between said structures on the side frame members of said railcar truck, with said second end-guide and said truss beam subassembly being coupled to each other while said railcar truck and said car body are maintained in operable association with each other; and providing a first brake head and a second brake head arranged in operable combination with and toward the first end and the second end, respectively, of said truss beam subassembly for movements toward and away from said wheels on said wheel and axle assembly as first and second end-guides slidably move within the structures on said side frame members.

2. The method according to claim 1 wherein the step of removing said damaged brake beam truss assembly involves the step of: disconnecting said brake rigging linkages from said damaged brake beam truss assembly.

3. The method according to claim 1 wherein the step of removing said damaged brake beam truss assembly involves the step of: shortening the operative length of said damaged brake beam truss assembly to facilitate removal of the damaged brake beam truss assembly while maintaining said railcar truck and said car body in operable association with each other.

4. The method according to claim 1 wherein the first end-guide defining said first end of said truss beam subassembly is formed as an integral part of the first brake head provided in operable combination with and toward the first end of said truss beam subassembly.

5. The method according to claim 1 further including the step of: maintaining compression between the first end and a second end of said compression member and tension between the first and a second end of said tension member of said truss beam subassembly prior to and after said truss beam subassembly and the second end-guide are coupled to each other.

6. The method according to claim 5 further including the step of:

providing a series of aligned openings toward the second ends of said compression and tension members disposed opposite from said first end of said truss beam subassembly.

7. The method according to claim 6 wherein the second end-guide is formed as an integral part of the second brake head provided in operable combination with and toward the second end of said truss beam subassembly.

8. The method according to claim 7 further including the step of: providing said second brake head, with said second end-guide formed as an integral part thereof, with a flange portion extending laterally outward and on an opposite side from second end-guide, with said flange portion defining a series of holes which align with the openings provided toward the second ends of said compression and tension members.

9. The method according to claim 8 wherein the step of coupling said second end-guide and the second end of said truss beam subassembly opposite from said first end-guide to each other to form said rigid brake beam unit includes the step of: providing a series of fasteners configured to pass endwise through the series of holes in the flange portion of the second brake head, with said second end-guide formed as an integral part thereof, and through the aligned openings toward the second ends of said compression and tension members, disposed opposite from said one end of said truss beam subassembly, to secure said second end-guide and the second end of said truss beam subassembly to each other to form said rigid brake beam unit.

10. A method for replacing a damaged brake beam connected to brake rigging linkages on a railcar having a car body supported on a railcar truck while maintaining said railcar truck and said car body in operable association with each other, said railcar truck including a pair of laterally spaced side frames for supporting an axle and wheels therebetween, with each of said side frames including, on an inboard side thereof, a brake beam guide extending for a length at least equivalent to the extent of travel of said brake beam, and with said brake beam guides on said side frames being separated by a predetermined distance, said method comprising the steps of:

removing said damaged brake beam from between said side frames of said railcar truck while maintaining said railcar truck and said car body in operable association with each other;

providing a brake beam subassembly comprised of a compression member and an angled tension member, said tension member having a maximum depth toward a mid-portion thereof, with a first end of each of said compression member and said tension member being secured together, and with a fixed guide member having a free distal end being disposed adjacent said first ends of said compression member and said tension member and defining a first end of said brake beam subassembly, and with a second end of each of said compression member and said tension member being maintained in predetermined relation relative to each other so as to maintain compression in said compression member and tension in said tension member, and wherein the operable length of said brake beam subassembly is shorter than the predetermined distance separating the brake beam guides on said side frames;

arranging said fixed guide member in operable combination with one of the brake beam guides on one of said side frames such that said fixed guide member is disposed to guide and support one end of said brake beam subassembly for sliding movements while maintaining said railcar truck and said car body in operable association with each other;

arranging a second guide member independent of said brake beam subassembly in operable combination with with the brake beam guide on other of said side frames such that said second guide member is guided and supported thereby while maintaining said railcar truck and said car body in operable association with each other;

coupling said second guide member and second end of the brake beam subassembly opposite from said first end to each other while maintaining said railcar truck and car body in operable association relative to each other to form a rigid brake beam unit guided and supported for sliding movements by and between the brake beam guides on said side frames; and providing a first brake head and a second brake head in operable combination with and toward the first end and a second end, respectively, of said brake beam subassembly for movements toward and away from said wheels as said fixed guide member and said second guide member move within the brake beam guides on said side frames.

11. The method according to claim 10 wherein the step of removing said damaged brake beam involves the step of: disconnecting linkages from said damaged brake beam.

12. The method according to claim 10 wherein the step of removing said damaged brake beam involves the step of: dividing one or more of the individual components comprising the damaged brake beam into pieces to facilitate removal of the damaged brake beam from between the side frames on said railcar while maintaining said railcar truck and said car body in operable association with each other.

13. The method according to claim 10 wherein the fixed guide member, defining the first end of said brake beam subassembly, is formed as an integral part of said first brake head provided in operable combination with and toward the first end of said brake beam subassembly.

14. The method according to claim 10 wherein the second guide member is formed as an integral part of said second brake head provided in operable combination with and toward the second end of said brake beam subassembly.

15. The method according to claim 14 further including the steps of: providing a series of openings arranged in a predetermined pattern relative to each other in the second of each of said compression member and said tension member; and providing said second brake head, having said second guide member formed as an integral part thereof, with a flange portion extending laterally outward and on an opposite side from the second guide member, with said flange portion on said second brake head defining a series of holes which align with the openings provided toward the second end of said compression member and said tension member after said flange and the second end of said brake beam subassembly are arranged in operable combination relative to each other.

16. The method according to claim 15 wherein the step of coupling said second guide member and the second end of said brake beam subassembly to each other to form a rigid brake beam unit includes the step of: providing a series of fasteners configured to pass endwise through the series of holes in the flange portion of the second brake head, having said second guide member formed as an integral part thereof, and through the aligned openings toward the second end of each of said compression member and said tension member to fasten said second guide member to the brake beam subassembly whereby forming said rigid brake beam unit.

17. A method for replacing a damaged brake beam connected to brake rigging linkages on a railcar having a car body supported on a railcar truck while maintaining said railcar truck and said car body inoperable association with each other, said railcar truck including first and second laterally spaced side frame for supporting an axle and wheels therebetween, with each side frame member including, on an inboard side thereof, a brake beam guide extending for a length at least equivalent to the extent of travel of said brake beam, and with said brake beam guides on said side frames being separated by a predetermined distance, and with said damaged brake beam having an operable length which is sized relative to the predetermined distance between said brake beam guides on said side frames, said method comprising the steps of:

removing said damaged brake beam from between said side frames of said railcar truck while maintaining said railcar truck and said car body in operable association with each other;

arranging a first part of a replacement brake beam structure into operably supported and guided relation with the brake beam guide on said first side frame while maintaining said railcar truck and said car body in operable association with each other, with said first part of said brake beam structure having an operative length shorter than the predetermined distance between the brake beam guides on said first and second side frames;

arranging a second part of said replacement brake beam structure into operably supported and guided relation with the brake beam guide on the second of said side frames while maintaining said railcar truck and said car body in operable association with each other, with said second part of said brake beam structure having an operative length shorter than the predetermined distance between the brake beam guides on said first and second side frames;

coupling said first and second parts of said replacement brake beam structure to each other to form a rigid assembly capable of withstanding the braking forces applied thereto during operation of said railcar and while maintaining said railcar truck and said car body in operable association with each other, with the combined operative lengths of said first and second parts of said replacement brake beam structure being substantially equivalent to the predetermined distance between the brake beam guides on said first and second side frames; and providing a brake head in operable combination with each of said first and second parts of said replacement brake beam structure for movements toward and away from said wheels as the first and second parts forming said rigid assembly move within the brake beam guides on said side frames.

18. The method according to claim 17 wherein the step of removing said damaged brake beam involves the step of: disconnecting said brake rigging linkages from said damaged brake beam.

19. The method according to claim 17 wherein the step of removing said damaged brake beam involves the step of: shortening the operative length of said damaged brake beam to facilitate removal of the damaged brake beam while maintaining said railcar truck and said car body in operable association with each other.

20. The method according to claim 17 wherein at least one of said first and second parts of said replacement brake beam structure includes an elongated compression member, an elongated and generally V-shaped tension member joined toward the ends thereof to said compression member, and a fulcrum disposed between the generally V-shaped tension member and said compression member.

21. The method according to claim 20 wherein said first and second parts of said replacement brake beam structure each include an end extension configured for sliding accommodation with one of the brake beam guides on one of said first and second side frames.

22. The method according to claim 21 wherein each end extension provided on said first and second parts of said replacement brake beam structure is formed as a part of said first and second brake heads arranged in operable combination with each of said first and second parts of said replacement brake beam structure.

23. The method according to claim 17 further including the step of: maintaining tension in said tension member and maintaining compression in said compression member before said part including said compression member and tension member is arranged in operably supported and guided relation with the respective brake beam guide on one of said side frames.

24. A method for replacing a damaged brake beam connected to brake rigging linkages on a railcar having a car body supported on a railcar truck while maintaining said railcar truck and said car body in operable association with each other, said railcar truck including a pair of laterally spaced side frames for supporting an axle and wheels therebetween, with each of said side frames including, on an inboard side thereof, a brake beam guide extending for a length at least equivalent to the extent of travel of said brake beam, and with said brake beam guides on said side frames being separated by a predetermined distance, said method comprising the steps of:

removing said damaged brake beam from between said side frames of said railcar truck while maintaining said railcar truck and said car body in operable association with each other;

providing a brake beam subassembly comprised of a compression member, an angled tension member, a first brake head, and a first guide member all secured toward a first end of said compression member and a first end of said tension member in fixed relation relative to each other, with said first guide member being configured to laterally extend beyond the joined ends of said compression member and said tension member to define one end of said brake beam subassembly, and with said brake beam subassembly having an operative length shorter than the predetermined distance between said brake beam guides on said side frames;

positioning a free distal end of said first guide member into one of the brake beam guides on one of said side frames to operably guide and support one end of said brake beam subassembly for sliding movements while maintaining said railcar truck and said car body in operable association with each other;

providing a second brake head independent of said brake beam subassembly, said second brake head including a second guide member extending from one side thereof;

arranging the second guide member on said second brake head into operably guided and supported relation with the brake beam guide on the other of said side frames while maintaining said railcar truck and said car body in operable association with each other coupling said second brake head and a second end of the brake beam subassembly opposite from said first end defined by said first guide member to each other while maintaining said railcar truck and car body in operable association relative to each other to form a rigid brake beam unit guided and supported for sliding movements by and between the brake beam guides on said side frames.

25. The method according to claim 24 wherein the step of removing said damaged brake beam assembly involves the step of: disconnecting linkages from said damaged brake beam.

26. The method according to claim 24 wherein the step of removing said damaged brake beam involves the step of: shortening one or more of the individual components comprising the damaged brake beam to facilitate removal of the damaged brake beam while maintaining said railcar truck and said car body in operable association with each other.

27. The method according to claim 24 wherein the first guide member defining one end of said brake beam subassembly is formed as an integral part of said first brake head.

28. The method according to claim 24 further including the step of: imparting compression to said compression member prior to arranging the free distal end of said first guide into one of the brake beam guides; and, imparting tension to said tension member prior to arranging a free distal end of said first guide into one of the brake beam guides.

29. The method according to claim 28 further including the step of: securing the compression and tension members in predetermined relation relative to each other toward said second end of said brake beam subassembly so as to maintain compression in said compression member and so as to maintain tension in said tension member.

30. The method according to claim 29 further including the step of: providing a series of aligned openings toward second ends of said compression and tension members.

31. The method according to claim 30 further including the step of: providing said second brake head with a flange portion extending laterally outward and on an opposite side of said brake head from second guide member, with said flange portion defining a series of holes which align with the openings provided toward the second ends of said compression and tension members.

32. The method according to claim 31 wherein the step of coupling said second brake head and the second end of said brake beam subassembly to each other includes the step of: providing a series of fasteners configured to pass endwise through the series of holes in the flange portion of the second brake head and through the openings toward the second ends of said compression and tension members to couple said second brake head to the brake beam subassembly whereby forming said rigid brake beam unit.

33. A method for replacing a damaged brake beam truss connected to brake rigging linkages on a railcar having a car body supported on a railcar truck, said railcar truck including a wheel and axle assembly including a pair of laterally spaced wheels mounted between a pair of laterally spaced side frames, with each side frame including brake beam supporting structure projecting laterally inwardly from the respective side frame for guiding and supporting said brake beam truss assembly, and with the structure on said side frames defining a predetermined lateral distance therebetween, said method comprising the steps of:

disconnecting said brake rigging linkages from said damaged brake beam truss;

raising that end of the railcar body from operable association with that truck having the damaged brake beam truss thereon;

removing that truck having the damaged brake beam truss thereon from beneath the raised end of said car body;

removing said damaged brake beam truss from between said side frames of said railcar truck while maintaining the side frames in positional relation with each other;

arranging a first end-guide defining a first end of a truss beam subassembly into operably guided and supported sliding relation relative to the brake beam supporting structure on one of said side frames, with said truss beam subassembly further including compression and tension members each having an end secured to each other by said first end-guide, and wherein the truss beam subassembly has an overall length shorter than the predetermined lateral distance between the brake beam supporting structure on said side frame members;

arranging a second end-guide into operably guided and supported sliding relation relative to the brake beam supporting structure on the other of said side frames, with said second end-guide having a free distal end;

coupling said second end-guide and a second end of said truss beam subassembly opposite from said first end-guide to each other to form a rigid brake beam unit and such that the free distal ends of the end-guides are guided and supported for sliding movements between said brake beam supporting structure on the side frames of said railcar truck; and providing first and second brake heads in operable combination with and toward the first and second ends, respectively, of said truss beam subassembly for movements toward and away from said wheels on said wheel and axle assembly as first and second end-guides slidably move within the brake beam supporting structures on said side frames.

34. The method according to claim 33 wherein the first end-guide defining one end of said brake beam truss subassembly is formed as an integral part of said first brake head.

35. The method according to claim 33 further including the step of: imparting compression to said compression member prior to arranging said first end-guide into operably guided and supported sliding relation relative to the brake beam supporting structure on said one of said side frames; and, imparting tension to said tension member prior to arranging said first end-guide into operably guided and supported sliding relation relative to the brake beam supporting structure on said one of said side frames.

36. The method according to claim 35 further including the step of: securing the compression and tension members in predetermined positional relation relative to each other toward the second end of said brake beam truss subassembly so as to maintain compression in said compression member and so as to maintain tension in said tension member.

37. The method according to claim 33 further including the step of: providing a series of aligned openings toward a second of said compression member and a second end of said tension member.

38. The method according to claim 33 wherein the second end-guide is formed as an integral part of the second brake head disposed opposite from said first end-guide.

39. The method according to claim 38 further including the step of: providing said second brake head with a flange portion extending laterally outward and on an opposite side of said brake head from second end-guide, with said flange portion on said second brake head defining a series of holes which align with the aligned openings provided toward the second ends of said compression and tension members.

40. The method according to claim 39 wherein the step of coupling said second end-guide and the second end of said truss beam subassembly to each other includes the step of: providing a series of fasteners configured to pass through the series of holes in the flange portion of the second brake head and through the aligned openings toward the second ends of said compression and tension members disposed opposite from said one end of said brake beam truss subassembly to secure said second brake head to the brake beam subassembly whereby forming said rigid brake beam unit.

41. A railcar brake beam assembly supported and guided by a railcar truck of a railcar and which allows for replacement of a damaged railcar brake beam while maintaining said railcar truck and a railcar body of said railcar in operable association relative to each other, with said rail car truck including a wheel and axle assembly supported at opposite ends by a pair of laterally spaced side frame members, with each side frame member having, on an inboard side thereof, structure for guiding and supporting said brake beam assembly for movement toward and away from wheels on said wheel and axle assembly, and with the structure on said inboard sides of said side frame members being separated by a predetermined distance, said railcar brake beam assembly comprising:

a first part including a compression member, a tension member having a maximum depth toward a mid-portion thereof, and a fulcrum disposed between and joined at opposite ends to said compression member and said tension member, with said compression member and said tension member being connected to each other at a first end thereof, and with said first part further including a fixed guide extending laterally outward from and fixedly connected to the first end of said compression member and said tension member, with said fixed guide being configured with a free end distal portion adapted to be accommodated in operable combination with the structure on the inboard side of one of said side frame members so as to operably guide and support the first part of said brake beam assembly for movement toward and away from one of the wheels of said wheel and axle assembly, and with said compression member and said tension member further being joined to each other at a second end thereof such that compression is maintained in said compression member and tension is maintained in said tension member prior to and after said brake beam assembly is arranged in operable combination with and between the structure between said side frame members for guiding and supporting said brake beam assembly for movement toward and away from wheels on said wheel and axle assembly, and wherein an operable length of said first part is shorter than the predetermined distance separating the structure on the inboard sides of said side frame members;

a second part including another guide configured with a free end distal portion adapted to be accommodated in operable combination with the structure on the inboard side of the other of said side frame members so as to operably guide and support the second part of said brake beam assembly for movement toward and away from the other wheel of said wheel and axle assembly, and wherein an operable length of said second part is shorter than the predetermined distance separating the structure on the inboard sides of said side frame members, and with said second part being configured to allow said second part to be operably coupled to the second end of said first part of said brake beam assembly through a series of fasteners passing through openings defined by said first and second parts of said brake beam assembly, and with said openings in said first and second parts aligning relative to each other after said first and second parts of said brake beam assembly are arranged in a predetermined relation relative to each other and operably between the structure on the inboard sides of said side frame members; and first and second brake heads arranged in operable combination with the first and second parts, respectively, of said railcar brake beam assembly for movement toward and away from the wheels of said wheel and axle assembly as said fixed guide and said another guide slidably move within the structures on said side frames.

42. The railcar brake beam assembly according to claim 41, wherein said fixed guide forms an integral part of said first brake head.

43. The railcar brake beam assembly according to claim 41, wherein said another guide forms an integral part of said second break head.

* * * * *